US005199292A

United States Patent [19]

Del Fabro et al.

[11] Patent Number: 5,199,292

[45] Date of Patent: Apr. 6, 1993

[54] ASSEMBLY TO BEND BUNDLES OF RODS

[75] Inventors: Giorgio Del Fabro, Cassacco-Fraz.Monegnacco; Marcello Del Fabro, Udine, both of Italy

[73] Assignee: M.E.P. Macchine Elettroniche Piegatrici SpA, Reana Del Rojale, Italy

[21] Appl. No.: 843,279

[22] Filed: Feb. 28, 1992

[30] Foreign Application Priority Data

Feb. 28, 1991 [IT] Italy ..... UD91A000026

[51] Int. Cl.[5] ..... B21D 7/022

[52] U.S. Cl. ..... 72/307; 72/294; 72/217; 72/422

[58] Field of Search ..... 72/307, 306, 294, 217-219, 72/388, 422

[56] References Cited

U.S. PATENT DOCUMENTS

| | | | |
|---|---|---|---|
| 3,580,023 | 5/1971 | Merrill | 72/461 |
| 4,492,105 | 1/1985 | Kutz | 72/422 |
| 4,681,210 | 7/1987 | Miki | 72/307 |
| 5,025,651 | 6/1991 | Del Fabro | 72/307 |

FOREIGN PATENT DOCUMENTS

| | | | |
|---|---|---|---|
| 238026 | 9/1987 | European Pat. Off. . | |
| 334353 | 3/1989 | European Pat. Off. . | |
| 379029 | 7/1990 | European Pat. Off. . | |
| 386457 | 9/1990 | European Pat. Off. . | |
| 1299482 | 7/1969 | Fed. Rep. of Germany . | |
| 3830 | 1/1987 | Japan | 72/307 |

*Primary Examiner*—Daniel C. Crane

*Attorney, Agent, or Firm*—Antonelli, Terry, Stout & Kraus

[57] ABSTRACT

Assembly to bend bundles of rods consisting of two or more rods, which are positioned and bent, one upon another, substantially in a position normal to a supporting bench (15) and are bent into the same shape at one and the same time, the assembly advantageously having the purpose of bending the bundle of rods (14) in four directions so as to produce any desired closed figure therewith, retaining means (12) with grippers (20) able to move vertically in guides (21) and to be retracted downwards being included upstream and downstream of the bending assembly (10) and substantially on the same axis as the bundle of rods (14).

6 Claims, 3 Drawing Sheets

3/3
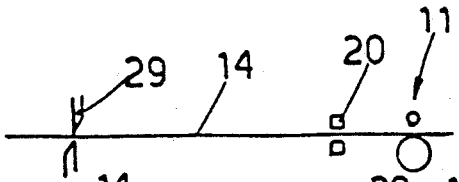
FIG. 4a
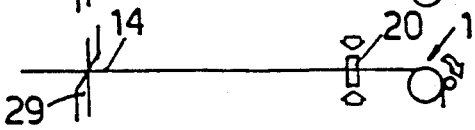
FIG. 4b
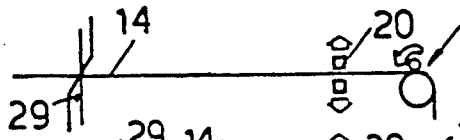
FIG. 4c
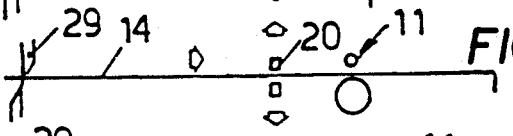
FIG. 4d
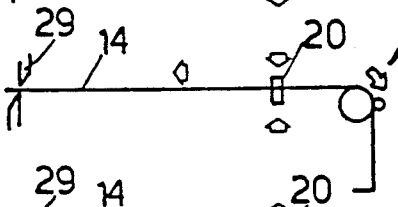
FIG. 4e
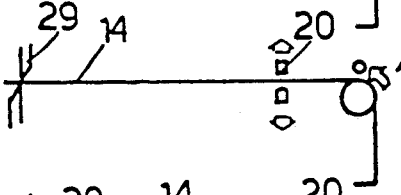
FIG. 4f
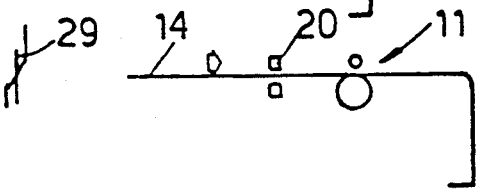
FIG. 4g
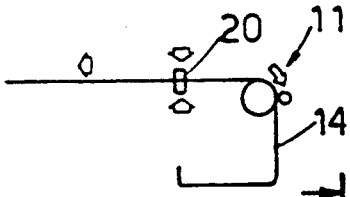
FIG. 4h
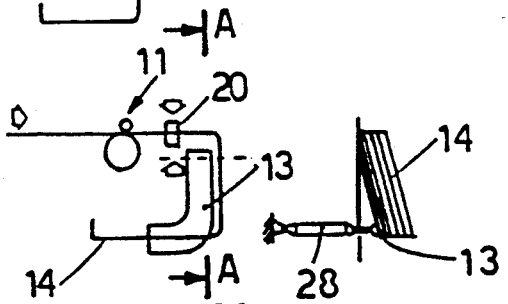
FIG. 4i
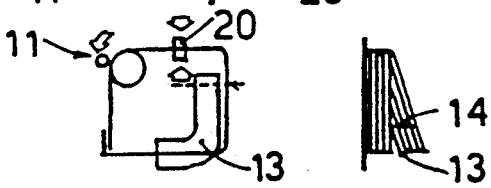
FIG. 4l
FIG. 3a
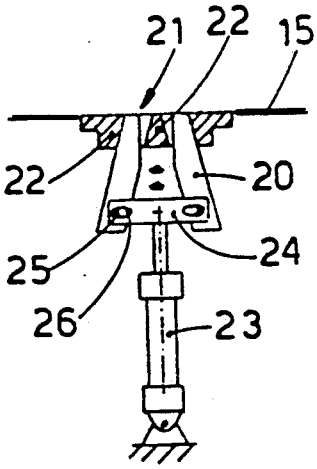
FIG. 3b
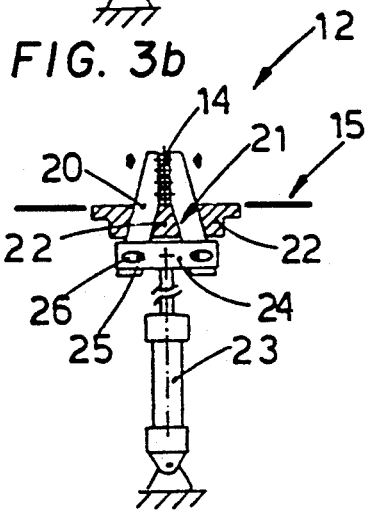

ASSEMBLY TO BEND BUNDLES OF RODS

This invention concerns an assembly to bend bundles of rods for building work.

By bundles of rods are meant rods which are two or more in number.

The invention is applied properly to all cases where bundles of rods are to be bent in four directions by means of a bending pin (or its equivalent) able to rotate about an axis by a desired angular value clockwise and anticlockwise.

The invention is especially advantageous where the figures obtained by bending the bundle of rods are closed figures.

The invention relates to a bending assembly which can be located downstream or upstream of a shears and/or a drawing unit and has the task of bending the bundle of rods according to a desired geometric configuration, which includes bends with a clockwise and anticlockwise development.

The bending assembly of this invention enables the same geometric configuration to be made in each of the rods composing the bundle.

Bending assemblies are not known at the present time which can bend at one and the same time and in an exactly identical manner each of the rods composing a bundle so as to produce even closed figures.

In the state of the art, in order to obtain with a plurality of rods geometric figures having the same configuration it is necessary to repeat the bending movements on each occasion for each single rod. This is so because in the step of closing and completing the geometric figure the end portion of the rods closing the figure comes into contact with the other end, or substantially end, portion of the same rods.

The necessity, therefore, of having to bend the rods individually entails a great consumption of energy and a considerable loss of time and a noteworthy delay in the production cycle.

Moreover, the need to act each time on each single rod individually may have the result that not all the figures produced have exactly the same required geometric configuration.

The present applicants have designed, tested and embodied this invention to overcome the shortcomings of the state of the art and to achieve further advantages.

The purpose of this invention is to provide a bending assembly suitable to carry out the bending of a bundle of rods in four directions so as to produce even closed figures.

The assembly to bend bundles of rods, as compared to the bending methods now applied to produce figures with the same configuration, entails many advantages such as a saving of time, simple working, lower energy consumption, better results and also shorter cycle times.

The assembly to bend bundles of rods comprises essentially a bending unit of a known type, retaining means and lifting arms.

The properly called bending unit may be of a rocker type for instance, as described in EP-A-379029, or of an orientable type as disclosed in EP-A-386457 or of any other type in which the bending element can be retracted and displaced laterally.

Retaining means are included upstream and downstream of the bending unit so as to hold the bundle of rods in position during the bending step.

Suitable lifting arms are comprised in cooperation with the bending assembly and enable the bending assembly to produce even figures which entail segments of the same figures being superimposed on each other, such lifting arms being of the type of FIG. 9 of EP-A-0238026 for instance.

The lifting arms have the task of lifting suitably the segment already bent, which otherwise would hinder the formation of the next bend to be made since it would obstruct the next bend.

The attached figures, which are given as a non-restrictive example, show some preferred embodiments of the invention as follows.

Figure 1:
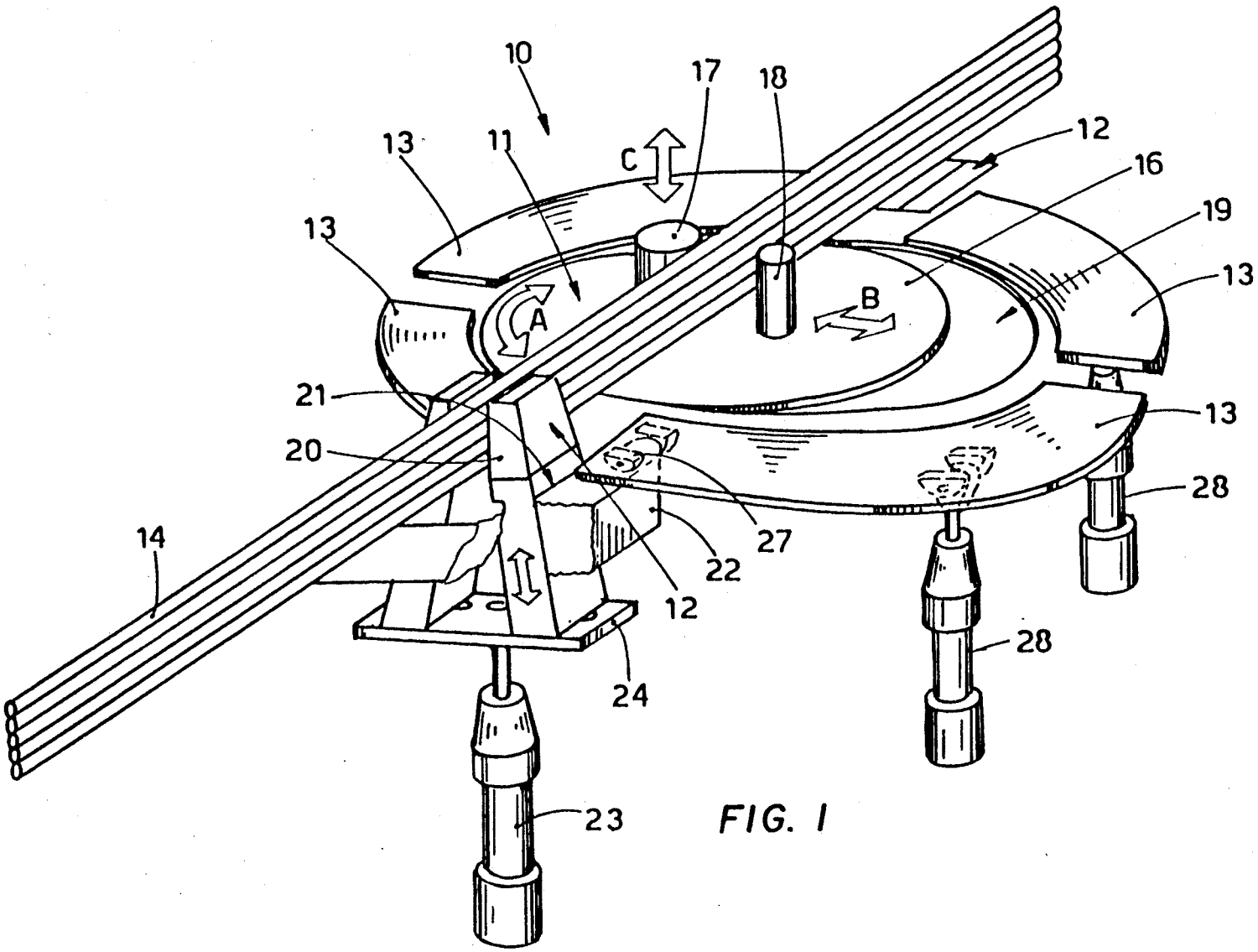
FIG. 1 is a partly cutaway three-dimentional diagram of an assembly to bend bundles of rods.

FIGS. 3*a* and 3*b* show cross sections of the retaining means and of the kinematic mechanisms of the same;

FIGS. 4*a*–4*j* show a possible bending cycle.

An assembly 10 to bend bundles of rods 14 according to the invention cooperates generally with a suitable supporting bench 15 and comprises essentially a bending unit 11, retaining means 12 and lifting arms 13.

The bending unit 11 is of a retractable type and may be, for instance, of a rocker type, as disclosed in EP-A-379029, or of an orientable type, as described in EP-A-386457, or of any other type suitable for the purpose.

Figure 2:
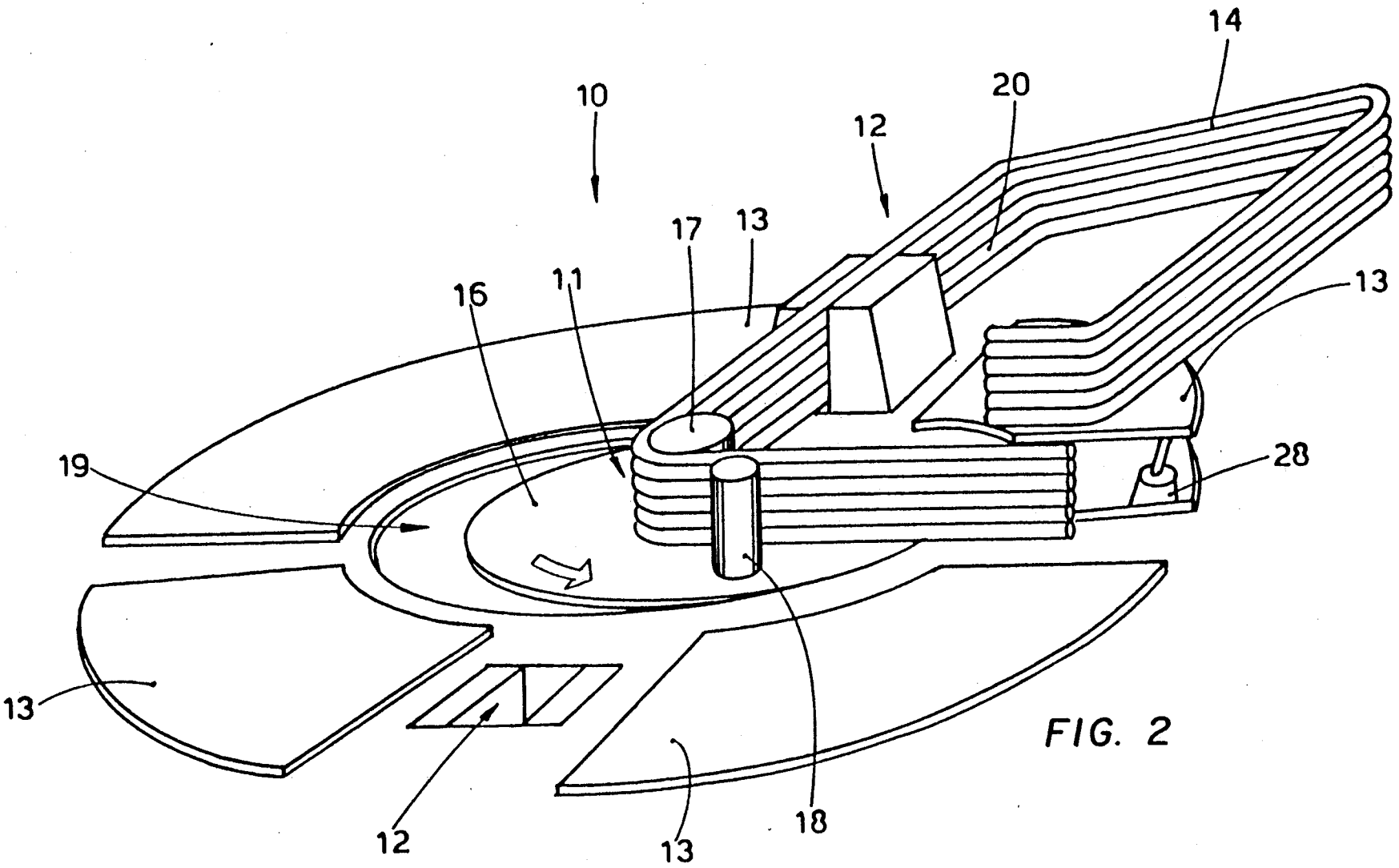
FIG. 2 shows the action of a lifting arm.

FIGS. 1 and 2 show a possible bending unit 11, of which only some of the parts are illustrated in the figures, the remaining parts being assumed to be known and therefore unimportant for the purposes of the invention. The parts illustrated are a bending disk 16, an abutment roll 17 and a bending pin 18.

According to the type shown as an example, the bending disk 16 can move within a containing hollow 19 in the supporting bench 15.

The bending disk 16 of the type shown can rotate clockwise or anticlockwise (A) about its own axis, and can move lengthwise (B) and vertically (C).

The combined action of these three freedoms of movement A-B-C enables clockwise or anticlockwise bends to be made on the bundle of rods 14 in four directions.

The abutment roll 17 and bending pin 18 have a height capable of holding all the rods of the bundle of rods 14.

The bundle of rods 14 contains two or more rods positioned one on top of another in a position substantially at a right angle to the supporting bench 15.

Retaining means 12 are included upstream and downstream of the bending unit so as to hold the bundle of rods 14 in position during the bending step.

The bends can be made in any of the four directions according to the intial positions applied to the abutment roll 17 and bending pin 18 in relation to the bundle of rods 14.

To be more exact, when the retaining means 12 positioned upstream of the bending unit 11 clamp the bundle of rods 14, clockwise or anticlockwise bends are produced at the leading end of the bundle 14 by means of clockwise or anticlockwise rotations respectively of the bending disk 16.

Instead, when the retaining means 12 downstream of the bending unit 11 clamp the bundle of rods 14, clockwise or anticlockwise bends are produced at the trailing end of the bundle 14 by means of clockwise or anticlockwise rotations respectively of the bending disk 16.

Suitable lifting arms 13 are included in cooperation with the bending unit 11 and enable figures to be produced which lead to the superimposing of segments of these figures (see FIG. 2).

The lifting arms 13 can be one in number when the figures to be produced are standardized and constant, or can be two or more in number when needed to comply with any bending requirement whatsoever.

In this case the lifting arms 13 are four in number, are positioned about the perimeter of the bending unit 11 and hinged on the supporting bench 15 by pivot pins 27 having their axes substantially parallel to the axis of the rods 14.

The position of the axis of the pivot pin 27 is located advantageously approximately on the vertical line of the plane containing the bundle of rods 14.

This position may also be distanced from that vertical line according to the invention.

The axis of the pivot pin 27 may also not be parallel to the axis of the bundle of rods 14.

The lifting arms 13–30 are operated by suitable actuators 28 secured in this example to the supporting bench 15.

When the actuators 28 are appropriately operated, the relative lifting arms 13 are displaced upwards and raise suitably the segment of the figure of rods already produced, since otherwise this segment would hinder the formation of the successive bend to be made on the bundle of rods 14.

According to the invention the retaining means 12 consist of two movable grippers 20, one of them upstream and the other downstream and on the same axis as the bundle of rods 14, which always lies at a tangent to the abutment roll 17 of the bending unit 11.

These movable grippers 20 cooperate with suitable guides 21 machined, in this case, in blocks 22 solidly fixed to the supporting bench 15.

These movable grippers 20 carry out essentially two steps (see FIGS. 3):

- a retracted step (FIG. 3*a*) in which the movable grippers 20 are contained wholly within the supporting bench 15, and
- a working step (FIG. 3*b*) in which, owing to the special conformation of the guides 21 according to a tapered development, which cooperates with the shape of the movable grippers 20, the grippers 20 clamp and, at the same time, align the bundle of rods 14.

The movable grippers 20 comprise a segment having substantially parallel sidewalls and cooperating with the guides 21. The movable grippers 20 also comprise a facing segment having flat parallel sidewalls and acting as the actual portion which grips and clamps the bundle of rods 14.

The movable grippers 20 cooperate at their lower end with a connecting shaft 24 on which an actuator 23 acts.

The more the movable grippers 20 are thrust upwards by the actuator 23, the more they tighten their grip on the bundle of rods 14.

The examples of FIGS. 3 show a connection between pins 25 solidly fixed to the movable grippers 20 and slots 26 machined in the connecting shaft 24; this type of connection makes possible a relative movement as between the movable grippers 20 and the connecting shaft 24 so as to enable the movable grippers 20 to be displaced upwards to clamp the bundle of rods 14.

FIG. 1 shows an equivalent system. The movable gripper 20 positioned upstream of the bending unit 11 clamps the bundle of rods 14 when it is necessary to make a bend in the leading end of the bundle 14 downstream of the bending unit 11, whereas the movable gripper 20 downstream of the bending unit 11 acts to provide bends in the trailing end of the bundle of rods 14 upstream of the bending unit 11.

The inner surfaces of the movable grippers 20 comprise advantageously knurled areas to prevent any sliding of the bundle of rods 14 during the bending step.

FIGS. 4*a*–4*j* show one application of the invention.

The bundle of rods 14 is positioned on the supporting bench 15, which comprises in this case suitable shears 29 of a known type (FIG. 4*a*).

When the bundle of rods 14 is correctly positioned for the first bend to be applied, the movable gripper 20 located upstream of the bending unit 11 is thrust upwards until the bundle of rods 14 has been aligned and clamped.

The bending unit 11 performs the first bend, for instance clockwise on the leading end of the bundle 14 (FIG. 4*b*).

Thereafter the upstream movable gripper 20 is opened (FIG. 4*c*) to allow the bundle of rods 14 to be fed forwards until it is suitably positioned for the second bend to be made (FIG. 4*d*); the bending unit 11 carries out the second bend, for instance a clockwise bend at the leading end of the bundle 14 (FIG. 4*e*).

The upstream movable gripper 20 releases the bundle 14, the bending unit 11 is re-positioned and the shears 29 shears the bundle 14 (FIG. 4*f*).

The bundle of rods 14 is now correctly positioned for the third bend to be made (FIG. 4*g*).

Thereafter the upstream movable gripper 20 clamps the bundle 14 again and the third bend is made, for instance a clockwise bend at the leading end of the bundle 14 (FIG. 4*h*).

FIG. 4*i* shows how the first bend would hinder formation of the fourth bend; instead, by lifting the appropriate lifting arm 13 it is possible to superimpose the leading segment of the bundle 14 so that this segment does not come into contact with the remaining parts of the bundle 14 during the bending step (see the cross section A—A of FIG. 4*i* shown at the side of the figure).

FIG. 4*l* shows the bundle of rods 14 after performance of the fourth bend, for instance an anticlockwise bend at the trailing end of the bundle 14; it should be noted that during the performance of this fourth bend the movable gripper 20 located downstream of the bending unit 11 has entered into action.

The side view of FIG. 4*l* (at the side of this figure) shows the lifting of the terminal part of the bundle 14 by the lifting arm 13 (see FIG. 2).

I claim:

1. An assembly to bend a plurality of rods at the same time into the same form, the plurality of rods being arranged in a bundle having one rod stacked on another in a first direction normal to a longitudinal axis of said rods, comprising:

- a supporting bench having a surface extending in a plane substantially normal to said first direction;
- a bending assembly having an abutment roll and a bending pin able to rotate about said abutment roll to bend said rods;
- a first retaining means including grippers movable in guides between a working position for fixedly clamping said bundle of rods and a retracted position below said surface of said supporting bench, said retracted position locating said first retaining means out of engagement with said rods, said first retaining means being positioned upstream of said bending assembly and substantially on said longitudinal axis of said rods; and a second retaining means including grippers movable in guides between a working position for fixedly clamping said bundle of rods and a retracted position below said surface of said supporting bench, said retracted position locating said second retaining means out of engagement with said rods, said second retaining means being positioned downstream of said bending assembly and substantially on said longitudinal axis of said rods.

2. An assembly as claimed in claim 1, wherein each of the guides of the first and second retaining means has a tapered development substantially in said first direction with a vertex above the supporting bench.

3. An assembly as claimed in claim 2, wherein each of the grippers of the first and second retaining means comprises a pair of opposed gripping jaws, each having at least one lower segment having substantially parallel sidewalls which cooperates with a respective guide.

4. An assembly as claimed in claim 3, wherein the opposed pair of gripping jaws of each of the grippers includes in an upper portion thereof having substantially counterpart facing segments having a parallel development extending in said first direction.

5. An assembly as claimed in claim 1, further comprising an array of lifting arms positioned substantially about a perimeter of said bending assembly for lifting the bundle of rods away from said bending assembly in said first direction.

6. Bending assembly as claimed in claim 5, wherein each of said lifting arms is pivotally connected to said supporting bench by a pivot pin extending substantially parallel to the longitudinal axis of the rods.

* * * * *